US010375815B2

(12) United States Patent
Song et al.

(10) Patent No.: US 10,375,815 B2
(45) Date of Patent: Aug. 6, 2019

(54) METHOD FOR ADJUSTING PARTICLE ORBIT ALIGNMENT BY USING FIRST HARMONIC IN CYCLOTRON

(71) Applicant: HEFEI CAS ION MEDICAL AND TECHNICAL DEVICES CO., LTD., Hefei, Anhui (CN)

(72) Inventors: Yuntao Song, Anhui (CN); Kaizhong Ding, Anhui (CN); Jian Ge, Anhui (CN); Kai Zhou, Anhui (CN); Yonghua Chen, Anhui (CN); Junjun Li, Anhui (CN); Hansheng Feng, Anhui (CN); Kun Pei, Anhui (CN); Jian Zhou, Anhui (CN); Zhong Wang, Anhui (CN); Xinyu Chen, Anhui (CN)

(73) Assignee: HEFEI CAS ION MEDICAL AND TECHNICAL DEVICES CO., LTD., Hefei (CN)

( * ) Notice: Subject to any disclaimer, the term of this patent is extended or adjusted under 35 U.S.C. 154(b) by 0 days.

(21) Appl. No.: 16/207,216

(22) Filed: Dec. 3, 2018

(65) Prior Publication Data

US 2019/0166681 A1 May 30, 2019

Related U.S. Application Data

(63) Continuation of application No. PCT/CN2018/076125, filed on Feb. 10, 2018.

(30) Foreign Application Priority Data

Nov. 30, 2017 (CN) ..... 2017 1 1242936

(51) Int. Cl.
*H05H 7/04* (2006.01)
*H05H 13/00* (2006.01)

(52) U.S. Cl.
CPC ..... *H05H 7/04* (2013.01); *H05H 13/005* (2013.01); *H05H 2007/048* (2013.01)

(58) Field of Classification Search
CPC .. H05H 7/04; H05H 13/005; H05H 2007/048; H05H 7/02; H05H 13/02; H05H 2007/025; H01J 25/62
(Continued)

(56) References Cited

U.S. PATENT DOCUMENTS 3,868,522 A 2/1975 Bigham et al.
7,481,904 B2 * 1/2009 Ishii ..... H01J 37/321 118/723 I

FOREIGN PATENT DOCUMENTS

CN 1395459 A 2/2003
CN 104244562 A 12/2014
(Continued)

OTHER PUBLICATIONS

Zhong Junqing, 100MeV cyclotron central area experimental bench magnetic field measurement and shimming,China Excellent Master's Thesis Full-text Database, Engineering Science Series II, Apr. 15, 2008, No. 4, ISSN: 1674-0246C040-25,50- 54.

*Primary Examiner* — Wei (Victor) Chan
(74) *Attorney, Agent, or Firm* — Wayne & Ken, LLC; Tony Hom

(57) ABSTRACT

The invention discloses a method for adjusting particle orbit alignment by using a first harmonic in a cyclotron, including the following steps: generating a correcting magnetic field through eight coils symmetrically about the middle plane; arranging the positions of the coils and the currents applied, so that they can generate a first harmonic of which the amplitude and phase are arbitrarily adjustable; according to the actual eccentricity of the particle orbit, adjusting the magnitude and direction of the currents applied to the coils, and optimizing the alignment of the particle trajectory. By
(Continued)

controlling an external DC power source of the accelerator and combining the real-time feedback of the beam detection of the accelerator, the invention may perform real-time adjustment during the debugging and operation of the accelerator, with high feasibility and operability; compared with traditional methods, the invention may achieve real-time adjustment during the debugging and operation of the accelerator.

7 Claims, 4 Drawing Sheets

(58) Field of Classification Search
USPC ..... 315/500, 501, 502, 503
See application file for complete search history.

(56) References Cited

FOREIGN PATENT DOCUMENTS

| | | | |
|---|---|---|---|
| CN | 106163073 | A | 11/2016 |
| CN | 107148140 | A | 9/2017 |
| JP | H02195637 | A | 8/1990 |
| JP | H0878200 | A | 3/1996 |

* cited by examiner

METHOD FOR ADJUSTING PARTICLE ORBIT ALIGNMENT BY USING FIRST HARMONIC IN CYCLOTRON

CROSS-REFERENCE TO RELATED APPLICATIONS

This application is a continuation of International Application No. PCT/CN2018/076125, filed on Feb. 10, 2018, which claims priority from Chinese Patent Application No. 201711242936.5, filed on Nov. 30, 2017, both of which are hereby incorporated by reference in their entireties.

TECHNICAL FIELD

The invention belongs to the technical field of cyclotrons, and particularly relates to a method for adjusting particle orbit alignment, and more particularly to a method for adjusting particle orbit alignment by using a first harmonic in a cyclotron.

BACKGROUND OF THE INVENTION

Orbit alignment is a very important indicator in the design of the central region of an accelerator. As the equilibrium orbit of a particle is usually symmetrical about the central region of a circle, if the acceleration orbit is not well aligned, the particle will deviate too far from the equilibrium orbit during acceleration, causing a large increase in radial amplitude. If the radial amplitude is too large and exceeds the radial acceptability of the corresponding equilibrium orbit, the particle may even be lost.

Usually in the design of the central region of the accelerator, particle alignment is optimized by adjusting the geometry of a DEE plate, changing the position of an ion source (in the case of an internal ion source), adjusting parameters of a deflector (in the case of an external ion source) and the like, and these methods depend on the design of the central region area, the accuracy of which depends on the experience and level of the designer. Real-time adjustment is impossible during debugging and operation, and adjustment means are not flexible enough.

In addition, the magnetic field cannot reach an ideal value due to errors in magnet installation during each installation and disassembly process of the accelerator, which will more or less influence particle trajectory, whereby real-time adjustment is necessary according to the eccentricity of the particle trajectory during the actual operation of the accelerator.

SUMMARY OF THE INVENTION

In order to overcome the above technical problems, an object of the invention is to provide a method for adjusting particle orbit alignment by using a first harmonic in a cyclotron. By providing a plurality of coils in the central area according to the characteristics that a first harmonic causes an overall offset of the orbit, adjusting the current magnitude and direction of the coils to construct a first harmonic with a suitable amplitude and phase to entirely offset the particle trajectory, thereby adjusting trajectory alignment, this method may perform real-time adjustment during the operation and debugging of the accelerator, increase adjustment accuracy, and is structurally simple and easy to implement.

The object of the invention can be achieved by the following technical solutions.

A method for adjusting particle orbit alignment using a first harmonic in a cyclotron, includes the following steps:

Step 1: providing eight identical coils in the vicinity of an extreme point of the magnetic field of the cyclotron, and covering the coils near the extreme point;

Step 2: dividing the eight coils into four pairs of coils, wherein a first pair of coils includes a first coil and a second coil symmetrically disposed above and below; a second pair of coils includes a third coil and a fourth coil symmetrically disposed above and below; a third pair of coils includes a fifth coil and a sixth coil symmetrically disposed above and below; a fourth pair of coils includes a seventh coil and an eighth coil symmetrically disposed above and below; and then the first pair of coils, the second pair of coils, the third pair of coils and the fourth pair of coils are divided into two groups; the first group of coils includes the first pair of coils and the third pair of coils that are symmetrically disposed; and the second group of coils includes the second pair of coils and the fourth pair of coils that are symmetrically disposed;

Step 3: setting the axes of the two pairs of coils of the same group at 180°;

Step 4: setting the axes of the first group of coils and the axis of the second group of coils at 70°-110° therebetween;

Step 5: connecting each coil to a DC power source external to the main unit of the accelerator via a current lead;

Step 6: applying currents with the same magnitude and same direction into the two coils in each pair of coils;

Step 7: applying currents with the same magnitude and opposite direction into two pairs of coils in the same group;

Step 8: after the currents are applied, the four coils in the first group of coils together generating a first independent harmonic, the four coils in the second group of coils together generating a second independent harmonic, and obtaining a first harmonic according to a vector sum of the first independent harmonic and the second independent harmonic;

Step 9: by using real-time feedback of beam detection of the cyclotron and according to the eccentricity of an equilibrium orbit of beam particles, performing real-time adjustment of the magnitude and direction of the currents applied to the coils by the DC power source; by changing the magnitude of the currents applied to the first group of coils and the second group of coils, changing the amplitude of the corresponding first independent harmonic and the second independent harmonic; by changing the direction of the currents applied to the first group of coils and the second group of coils, changing the positive or negative direction of the phase of the corresponding first independent harmonic and the second independent harmonic; and further changing the amplitude and phase of the first harmonic, that is, achieving alignment adjustment of the equilibrium orbit of the beam particles.

As a further solution of the invention, the angle between the axes of the first pair of coils and the third pair of coils is 180°, and the angle between the axes of the second pair of coils and the fourth pair of coils is 180°.

As a further solution of the invention, the angle between the axes of the adjacent two pairs of coils is 70°-110°.

As a further solution of the invention, the currents applied to the first pair of coils and the third pair of coils have the same magnitude and opposite directions, and the currents applied to the second pair of coils and the fourth pair of coils have the same magnitude and opposite directions.

As a further solution of the invention, the amplitude of the first independent harmonic is proportional to the magnitude of the current applied, and the phase of the first independent harmonic depends on the placement position of the first group of coils, and does not change with the magnitude of the current.

As a further solution of the invention, the amplitude of the second independent harmonic is proportional to the magnitude of the current applied, and the phase of the second independent harmonic depends on the placement position of the second group of coils, and does not change with the magnitude of the current.

As a further solution of the invention, the angle between the first group of coils and the second group of coils is 70°-110°, and the phase difference between the first independent harmonic and the second independent harmonic is 70°-110° and does not change with the magnitude of the current.

The invention has the following advantages: the principle of the invention is simple and reliable; by controlling the external DC power source of the accelerator and combining the real-time feedback of the beam detection of the accelerator, the invention may perform real-time adjustment during the debugging and operation of the accelerator, with high feasibility and operability; compared with traditional methods such as modifying the shape of a DEE plate or modifying the position of an ion source, the invention may achieve real-time adjustment during the debugging and operation of the accelerator, which increases adjustment flexibility and improves adjustment accuracy.

BRIEF DESCRIPTION OF THE DRAWINGS

The invention will now be further described with reference to the accompanying drawings.

Figure 1:
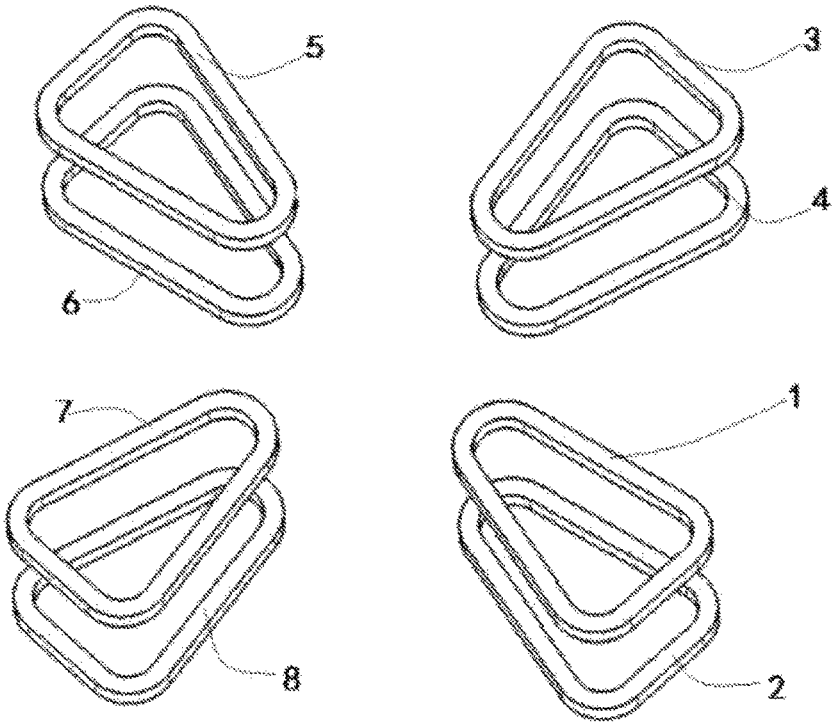
FIG. 1 is a schematic structural view of eight coils of the invention.

Reference signs in the drawings: 1—first coil; 2—second coil; 3—third coil; 4—fourth coil; 5—fifth coil; 6—sixth coil; 7—seventh coil; 8—eighth coil; 9—first pair of coils; 10—second pair of coils; 11—third pair of coils; 12—fourth pair of coils; 13—first independent harmonic; 14—second independent harmonic; 15—first harmonic; 16—equilibrium orbit without first harmonic; 17—equilibrium orbit with first harmonic;

DETAILED DESCRIPTION OF THE INVENTION

The technical solutions in the embodiments of the invention are clearly and completely described in the following with reference to the embodiments of the invention. It is obvious that the described embodiments are only a part of the embodiments of the invention, and not all of the embodiments. All other embodiments obtained by a person of ordinary skill in the art based on the embodiments of the invention without creative efforts fall within the scope of protection of the invention.

The theoretical basis on which the invention is based is as follows.

The magnetic field in the cyclotron is a magnetic field periodically distributed in azimuth, and after Fourier expansion is made on the periodic magnetic field, the magnetic field can be decomposed into an average field, a first harmonic, a second harmonic and the like. The first harmonic component is $B_1(r)\cos[\theta-\delta_1(r)]$, which has two characteristics: first harmonic amplitude $B_1(r)$ and first harmonic phase $\delta_1(r)$. Once the amplitude and phase is determined, the first harmonic is uniquely determined.

The first harmonic mainly affects the equilibrium orbit of the ideal particle.

Assuming that there is no first harmonic, the equilibrium orbit of the ideal particle is $r(\theta)$, and after the first harmonic is added, the new equilibrium orbit is $r^*(\theta)$, and the equilibrium orbit change $\Delta r(\theta)$ caused by the first harmonic is:

$$\Delta r(\theta) = r^*(\theta) - r(\theta) \approx r_0 \frac{f_1}{1 - Q_r^2} \cos(\theta - \delta_1)$$

In the above formula, $r_0$ is the $$f_1 = \frac{B_1}{B_0}$$

average radius of the orbit, $Q_r$ is the radial oscillation frequency of the particle, is the relative amplitude of the first harmonic, and $\delta_1$ is the phase of the first harmonic.

From the above formula, the following three conclusions can be obtained: ① where $Q_r>1$, the orbit is reduced at $\theta=\delta_1$ by $$r_0 \frac{f_1}{Q_r^2 - 1},$$

and is increased at $\theta=\delta_1+180°$ by $$r_0 \frac{f_1}{Q_r^2 - 1},$$

that is, the first harmonic causes the overall offset of the equilibrium orbit toward the opposite direction of the phase of the first harmonic; ② where $Q_r<1$, the orbit is increased at $\theta=\delta_1$ by $$r_0 \frac{f_1}{Q_r^2 - 1},$$

and is reduced at $\theta=\delta_1+180°$ by $$r_0 \frac{f_1}{Q_r^2 - 1},$$

that is, the first harmonic causes the overall offset of the equilibrium orbit in the same direction of the phase of the first harmonic; ③ under the effect of the same first harmonic, the closer $Q_r$ is to 1, the larger the orbit change $\Delta r(\theta)$ is.

Since the first harmonic can cause the overall offset of beams in the same or opposite direction of the phase, as long as the amplitude and phase of the first harmonic are properly controlled, the equilibrium orbit can be offset to the central region of the circle to achieve the purpose of alignment adjustment.

Figure 2:
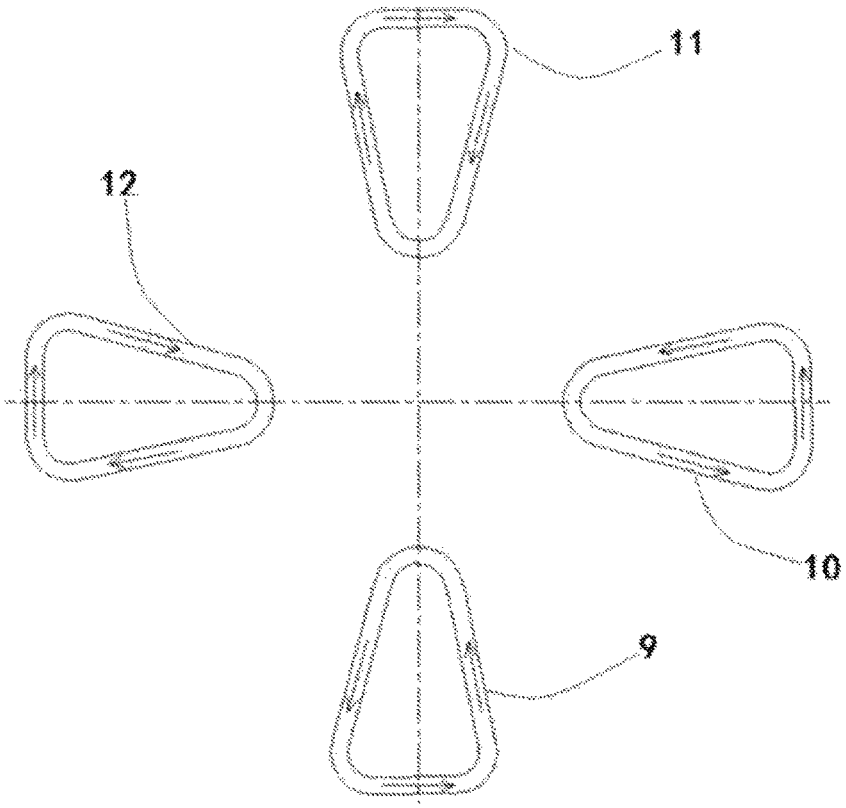
FIG. 2 is a top view of FIG. 1.
Figure 3:
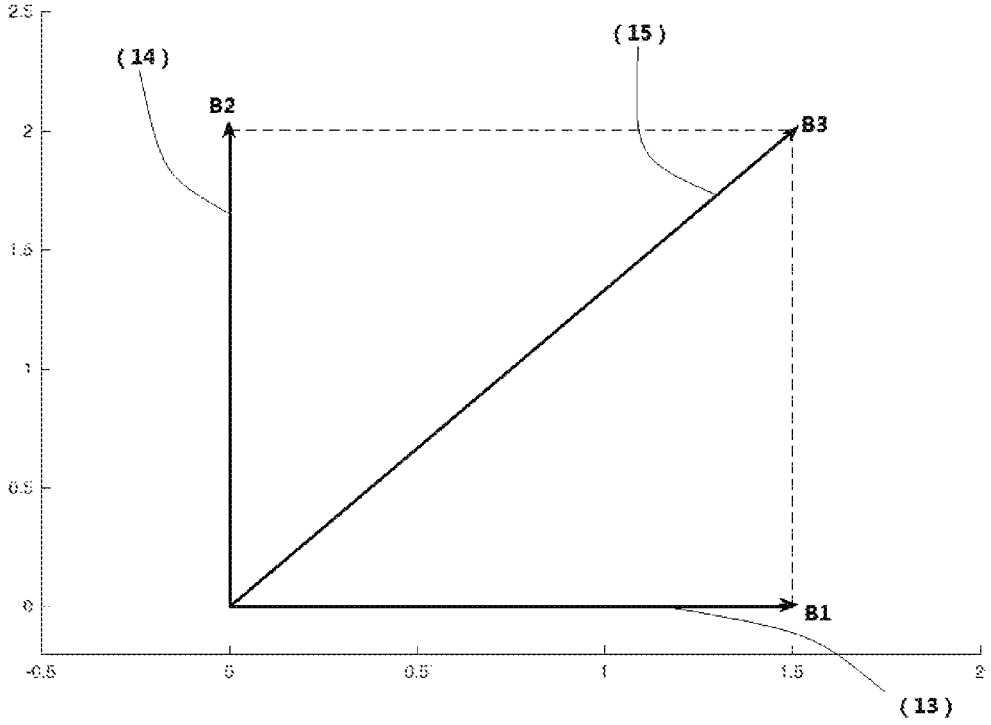
FIG. 3 is a schematic diagram of combing a first independent harmonic and a second independent harmonic to form a first harmonic.

A method for adjusting particle orbit alignment using a first harmonic in a cyclotron, includes the following steps:

Step 1: first analyzing the magnetic field of the accelerator and finding the region where the magnetic field of the accelerator $Q_r$=1. Usually, the region with $Q_r$=1 is located near an extreme point of the magnetic field (for example, the peak and valley of the Bump field in the central area), as shown in FIG. 1 in which eight identical coils are placed in the vicinity of an extreme point of the magnetic field of the accelerator, covering the area near the extreme point;

Step 2: as shown in FIG. 2, dividing the eight coils into four pairs of coils, wherein a first pair of coils 9 includes a first coil 1 and a second coil 2 symmetrically disposed above and below, a second pair of coils 10 includes a third coil 3 and a fourth coil 4 symmetrically disposed above and below, a third pair of coils 11 includes a fifth coil 5 and a sixth coil 6 symmetrically disposed above and below, and a fourth pair of coils 12 includes a seventh coil 7 and an eighth coil 8 symmetrically disposed up and down, and dividing the first pair of coils 9, the second pair of coils 10, the third pair of coils 11 and the fourth pair of coils 12 into two groups, the first group of coils including the first pair of coils 9 and the third pair of coils 11 symmetrically disposed, the second group of coils including a second pair of coils 10 and a fourth pair of coils 12 symmetrically disposed;

Step 3: setting the axes of the two pairs of coils of the same group at 180°, that is, the angle between the axes of the first pair of coils 9 and the third pair of coils 11 is 180°, and the angle between the axes of the second pair of coils 10 and the fourth pair of coils 12 is 180°;

Step 4: setting the axes of the first group of coils and the second group of coils at 70°-110°, that is, the angle between the axes of the adjacent pairs of coils is 70°-110°;

Step 5: connecting each coil to a DC power source external to the main unit of the accelerator via a current lead;

Step 6: applying currents with the same magnitude and same direction into the two coils in each pair of coils, for example, currents with the same magnitude and same direction are applied into the first coil 1 and the second coil 2 of the first pair of coils 9, currents with the same magnitude and same direction are applied into the third coil 3 and the fourth coil 4 of the second pair of coils 10, and so on;

Step 7: applying currents with the same magnitude and opposite direction into two pairs of coils in the same group, that is, currents with the same magnitude and opposite direction are applied into the first pair of coils 9 and the third pair of coils 11, currents with the same magnitude and opposite direction are applied into the second pair of coils 10 and the fourth pair of coils 12, as shown in FIG. 2, in which the arrows indicate the direction of the currents;

Step 8: as shown in FIG. 3, after the currents are applied, the four coils in the first group of coils together generating a first independent harmonic 13, the four coils in the second group of coils together generating a second independent harmonic 14, and obtaining a first harmonic 15 according to a vector sum of the first independent harmonic 13 and the second independent harmonic 14;

wherein the amplitude of the first independent harmonic 13 is proportional to the magnitude of the current applied, and the phase of the first independent harmonic 13 depends on the placement position of the first group of coils, and does not change with the magnitude of the current;

the amplitude of the second independent harmonic 14 is proportional to the magnitude of the current applied, and the phase of the second independent harmonic 14 depends on the placement position of the second group of coils, and does not change with the magnitude of the current;

as the angle between the first group of coils and the second group of coils is 70°-110°, the phase difference between the first independent harmonic 13 and the second independent harmonic 14 is 70°-110° and does not change with the magnitude of the current;

as shown in FIG. 3, B1 is the first independent harmonic 13, the length of B1 is the amplitude of the first independent harmonic 13, the azimuth of B1 is the phase of the first independent harmonic 13, B2 is the second independent harmonic 14, the length of B2 is the amplitude of the second independent harmonic 14, the azimuth of B2 is the phase of the second independent harmonic 14, and B3 is the first harmonic 15;

Step 9: by using real-time feedback of beam detection of the cyclotron and according to the eccentricity of the equilibrium orbit of beam particles, performing real-time adjustment of the magnitude and direction of the currents applied to the coils by the DC power source; by changing the magnitude of the currents applied to the first group of coils and the second group of coils, changing the amplitude of the corresponding first independent harmonic 13 and the second independent harmonic 14; by changing the direction of the currents applied to the first group of coils and the second group of coils, changing the positive or negative direction of the phase of the corresponding first independent harmonic 13 and the second independent harmonic 14; and further changing the amplitude and phase of the first harmonic 15, achieving alignment adjustment of the equilibrium orbit of the beam particles.

It should be noted that the invention only requires that the first independent harmonic 13 and the second independent harmonic 14 are not parallel, and does not require that the angle between the first independent harmonic 13 and the second independent harmonic 14 has to be 90°. However, considering adjustment efficiency, in order to achieve an expected first harmonic intensity, the closer the angle between the first independent harmonic 13 and the second independent harmonic 14 is to 90°, the smaller the current required, so the angle between the first independent harmonic 13 and the second independent harmonic 14 is preferably close to 90°, preferably not less than 70°, that is, the angle between the first group of coils and the second group of coils is preferably not less than 70°.

At the same time, since opposite currents are applied to the opposite coils of the same group, the average field of the same group of coils is zero. No matter how much current is applied, only the amplitude of the first harmonics 15 is changed, thereby avoiding influence on the original average field.

Figure 4:
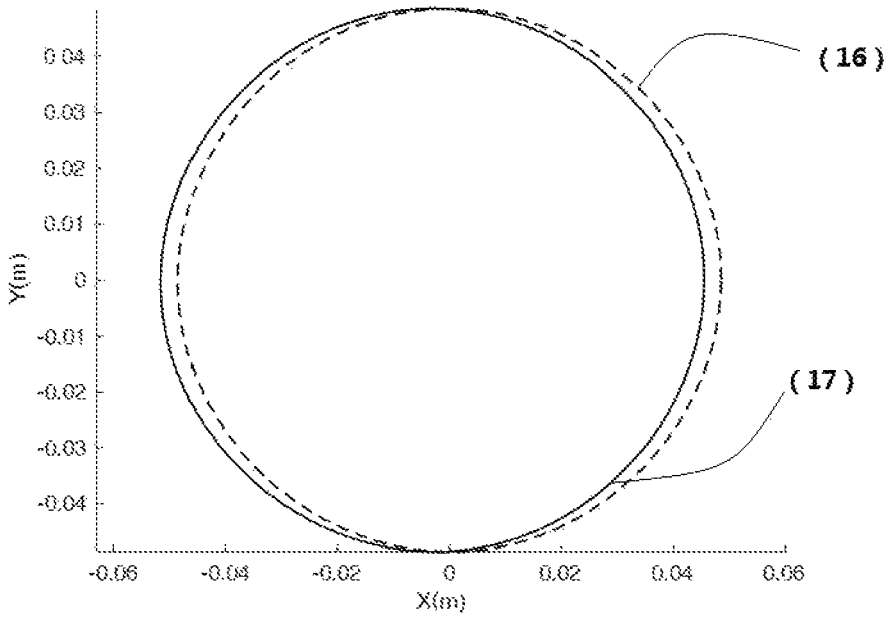
FIG. 4 is a schematic diagram of the first harmonic causing an equilibrium orbit offset.

FIG. 4 shows the effect of the equilibrium orbit 17 with a first harmonic on the equilibrium orbit 16 without a first harmonic.

The whole process is controlled by an external DC power source, and combined with the real-time feedback of the beam detection of the accelerator, real-time adjustment may be performed during the debugging and operation of the accelerator, which is very convenient and can achieve high alignment accuracy.

In the description of the present specification, the description of the reference terms "one embodiment", "example", "specific example" and the like means that the specific features, structures, materials or characteristics described in conjunction with the embodiment or the example are included in at least one embodiment or example in the invention. In the present specification, the schematic representation of the above terms does not necessarily refer to the same embodiment or example. Furthermore, the specific features, structures, materials or characteristics described may be combined in a suitable manner in any one or more embodiments or examples.

The forgoing is merely illustrative and descriptive of the structure of the invention, and those skilled in the art can make various modifications or additions to the specific embodiments described or replace them in a similar manner, as long as they do not deviate from the structure of the invention or the scope defined by the claims, such modifications or additions or substitutions are intended to fall within the scope of protection of the invention.

What is claimed is:

1. A method for adjusting particle orbit alignment using a first harmonic in a cyclotron, characterized by comprising the following steps:

Step 1: providing eight identical coils in the vicinity of an extreme point of the magnetic field of the cyclotron, and covering the coils near the extreme point;

Step 2: dividing the eight coils into four pairs of coils, wherein a first pair of coils (9) includes a first coil (1) and a second coil (2) symmetrically disposed above and below; a second pair of coils (10) includes a third coil (3) and a fourth coil (4) symmetrically disposed above and below; a third pair of coils (11) includes a fifth coil (5) and a sixth coil (6) symmetrically disposed above and below; a fourth pair of coils (12) includes a seventh coil (7) and an eighth coil (8) symmetrically disposed above and below; and then the first pair of coils (9), the second pair of coils (10), the third pair of coils (11) and the fourth pair of coils (12) are divided into two groups; the first group of coils includes the first pair of coils (9) and the third pair of coils (11) that are symmetrically disposed; and the second group of coils includes the second pair of coils (10) and the fourth pair of coils (12) that are symmetrically disposed;

Step 3: setting the axes of the two pairs of coils of the same group at 180°;

Step 4: setting the axes of the first group of coils and the axis of the second group of coils at 70°-110° therebetween;

Step 5: connecting each coil to a DC power source external to the main unit of the accelerator via a current lead;

Step 6: applying currents with the same magnitude and same direction into the two coils in each pair of coils;

Step 7: applying currents with the same magnitude and opposite direction into two pairs of coils in the same group;

Step 8: after the currents are applied, the four coils in the first group of coils together generating a first independent harmonic (13), the four coils in the second group of coils together generating a second independent harmonic (14), and obtaining a first harmonic (15) according to a vector sum of the first independent harmonic (13) and the second independent harmonic (14), Step 9: by using real-time feedback of beam detection of the cyclotron and according to the eccentricity of an equilibrium orbit of beam particles, performing real-time adjustment of the magnitude and direction of the currents applied to the coils by the DC power source; by changing the magnitude of the currents applied to the first group of coils and the second group of coils, changing the amplitude of the corresponding first independent harmonic (13) and the second independent harmonic (14); by changing the direction of the currents applied to the first group of coils and the second group of coils, changing the positive or negative direction of the phase of the corresponding first independent harmonic (13) and the second independent harmonic (14); and further changing the amplitude and phase of the first harmonic (15), that is, achieving alignment adjustment of the equilibrium orbit of the beam particles.

2. The method for adjusting particle orbit alignment using the first harmonic in a cyclotron according to claim 1, the angle between the axes of the first pair of coils (9) and the third pair of coils (11) is 180°, and the angle between the axes of the second pair of coils (10) and the fourth pair of coils (12) is 180°.

3. The method for adjusting particle orbit alignment using the first harmonic in a cyclotron according to claim 1, the angle between the axes of the adjacent two pairs of coils is 70°-110°.

4. The method for adjusting particle orbit alignment using the first harmonic in a cyclotron according to claim 1, the currents applied to the first pair of coils (9) and the third pair of coils (11) have the same magnitude and opposite directions, and the currents applied to the second pair of coils (10) and the fourth pair of coils (12) have the same magnitude and opposite directions.

5. The method for adjusting particle orbit alignment using the first harmonic in a cyclotron according to claim 1, the amplitude of the first independent harmonic (13) is proportional to the magnitude of the current applied, and the phase of the first independent harmonic (13) depends on the placement position of the first group of coils, and does not change with the magnitude of the current.

6. The method for adjusting particle orbit alignment using the first harmonic in a cyclotron according to claim 1, the amplitude of the second independent harmonic (14) is proportional to the magnitude of the current applied, and the phase of the second independent harmonic (14) depends on the placement position of the second group of coils, and does not change with the magnitude of the current.

7. The method for adjusting particle orbit alignment using the first harmonic in a cyclotron according to claim 1, the angle between the first group of coils and the second group of coils is 70°-110°, and the phase difference between the first independent harmonic (13) and the second independent harmonic (14) is 70°-110° and does not change with the magnitude of the current.

* * * * *